US005084968A

United States Patent [19]

Trotta

[11] Patent Number: 5,084,968

[45] Date of Patent: Feb. 4, 1992

[54] RAZOR BLADE ASSEMBLY

[75] Inventor: Robert A. Trotta, Pembroke, Mass.

[73] Assignee: The Gillette Company, Boston, Mass.

[21] Appl. No.: 579,838

[22] Filed: Sep. 10, 1990

[51] Int. Cl.[5] ..... B26B 21/00; B26B 21/14

[52] U.S. Cl. ..... 30/47; 30/50

[58] Field of Search ..... 30/41, 47, 48, 49, 50, 30/51, 77.81, 47.50

[56] References Cited

U.S. PATENT DOCUMENTS

| | | | |
|---|---|---|---|
| 2,439,909 | 4/1948 | Ruskin | 30/346 |
| 2,691,217 | 10/1954 | Clark | 30/50 |
| 3,675,323 | 7/1972 | Braginetz | 30/32 |
| 3,786,563 | 1/1974 | Dorion, Jr. et al. | 30/50 |
| 3,940,853 | 2/1976 | Francis | 30/50 |
| 4,031,620 | 6/1977 | Pomfret | 30/346 |
| 4,170,821 | 10/1979 | Booth | 30/41 |
| 4,184,247 | 1/1980 | Poisson | 30/59 |
| 4,443,940 | 4/1984 | Francis et al. | 30/50 |
| 4,573,266 | 3/1986 | Jacobson | 30/41 |
| 4,586,255 | 5/1986 | Jacobson | 30/41 |
| 4,587,729 | 5/1986 | Jacobson | 30/41 |
| 4,624,051 | 11/1986 | Apprill, Jr. et al. | 30/50 |
| 4,807,360 | 2/1989 | Cerier et al. | 30/49 |
| 4,833,779 | 5/1989 | Iten | 30/47 |

FOREIGN PATENT DOCUMENTS

| | | | |
|---|---|---|---|
| 2155383 | 9/1985 | United Kingdom | 30/47 |

*Primary Examiner*—Douglas D. Watts
*Assistant Examiner*—Paul M. Heyrana, Sr.

[57] ABSTRACT

A razor blade assembly comprising a platform member, blade means mounted on the platform member, the blade means having cutting edge means generally facing in a direction toward at least one side of the platform member, and a frame member adapted to receive the platform member interiorly of the frame member, the platform member and frame member being adapted to snap together such that the frame member extends around the platform member and provides skin engaging surfaces adjacent at least one side of the platform member.

17 Claims, 4 Drawing Sheets

RAZOR BLADE ASSEMBLY

BACKGROUND OF THE INVENTION

1. Field of the Invention

The invention relates to a blade assembly for a wet-shave type razor and is directed more particularly to a blade assembly having thereon a replaceable shaving aid body.

2. Description of the Prior Art

It is known in the prior art to provide a razor blade assembly with a shaving aid strip affixed to one of the skin engaging components of the assembly. In U.S. Pat. No. 4,573,266, issued Mar. 4, 1986 to Chester F. Jacobson, for example, there is shown such a strip attached to a blade assembly cap portion. The shaving aid comprises a formed mixture of a hydrophobic material and a water leachable hydrophillic material, which may serve as a lubricant, moisturizer, conditioner, or the like. During shaving, water present activates and causes leaching out of the hydrophillic material.

U.S. Pat. No. 4,586,255, issued May 5, 1986 to Chester F. Jacobson, and U.S. Pat. No. 4,587,729, issued May 13, 1986 to Chester F. Jacobson, are further examples of razor blade cartridges having shaving aid members attached thereto.

It has been suggested in the prior art, as for example, in U.S. Pat. No. 4,170,821, issued Oct. 16, 1970, to Anthony M. Booth, that the shaving aid may be one of any available diverse materials appropriate for various applications, such as a lubricating agent, a depilatory agent, a cleaning agent, a medicinal agent, a cosmetic agent, and the like. In practice, shaving aid strips available to the public are of the lubricating type. Razor blade assemblies are provided with shaving aids of the lubricating type because lubrication of the skin is desired almost all the time, whereas the other possible attributes of shaving aids, such as a medicinal attribute, for example, may be desirable only occasionally.

Accordingly, it would be beneficial to provide a blade assembly in which the shaving aid is replaceable, such that for given occasions a specialized shaving aid may be substituted for a lubricating shaving aid for one or two shaves, and thereafter the specialized shaving aid replaced by the previous, or another, lubricating shaving strip.

SUMMARY OF THE INVENTION

It is therefore an object of the invention to provide a blade assembly having as a part thereof a replaceable shaving aid strip means, such that a plurality of shaving aid strips may be used in conjunction with a given blade means.

With the above and other objects in view, as will hereinafter appear, a feature of the present invention is the provision of a razor blade assembly comprising a platform member including a first side wall, a second side wall, end walls interconnecting the first and second side walls, blade means mounted on the platform member, the blade means comprising cutting edge means generally facing in the direction of the first side wall and/or cutting edge means generally facing in the direction of the second side wall, first connection means disposed on the platform member, and a frame member having first and second side walls interconnected by end walls, the frame member being adapted to receive the platform member interiorly of the frame member, and second connection means disposed on the frame member and adapted to engage the platform member first connection means to releasably connect the frame member to the platform member.

In accordance with a further feature of the invention, at least one of the frame member first and second side walls comprises a shaving aid body adapted to be in skin engageable position adjacent at least one of the side walls of the platform member when the platform member and frame member are connected together.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
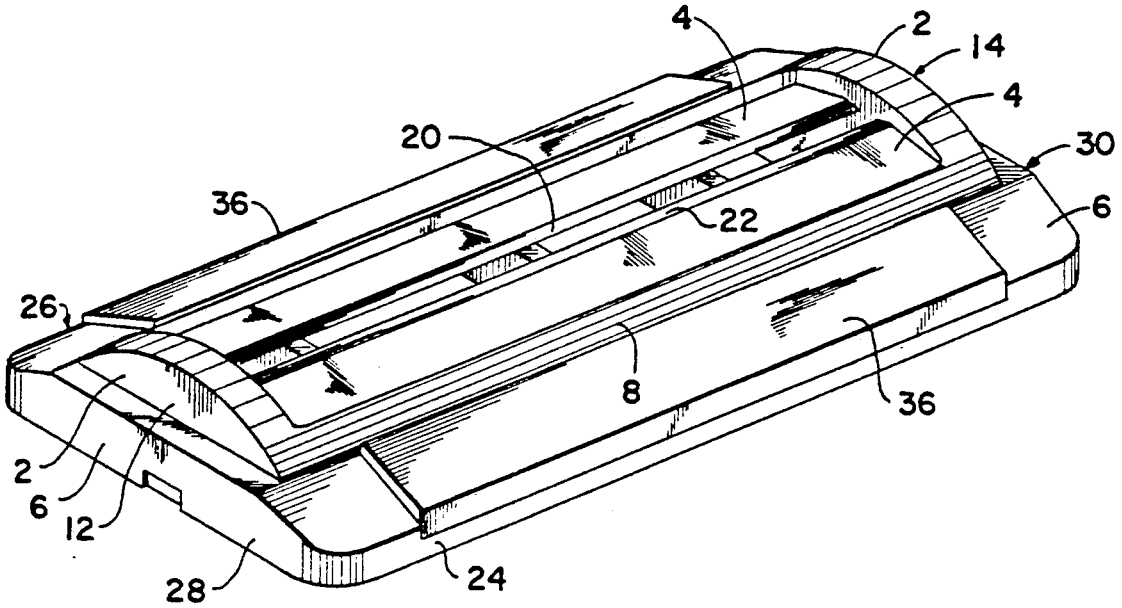
FIG. 1 is a perspective view of one form of razor blade assembly illustrative of an embodiment of the invention.
Figure 2:
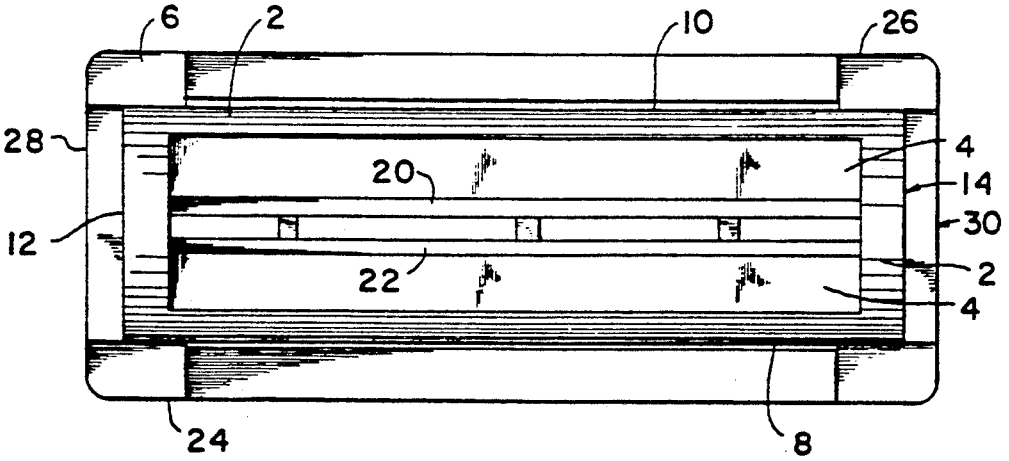
FIG. 2 is a top plan view of the blade assembly shown in FIG. 1.

Referring to the drawings, and particularly FIGS. 1 and 2, it will be seen that the illustrative razor blade assembly includes a platform member 2, blade means 4 mounted on the platform member, and a frame member 6 which is connectable to, and releasable from, the platform member 2.

Figure 3:
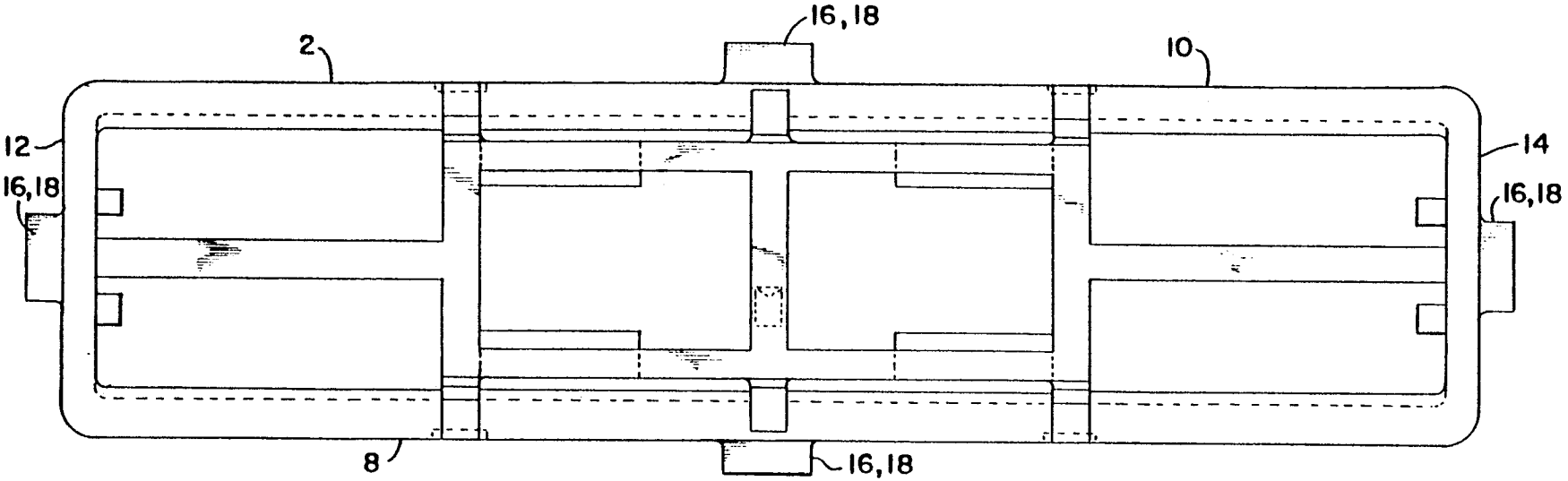
FIG. 3 is a top plan view of a platform member of the blade assembly shown in FIG. 2.
Figure 4:
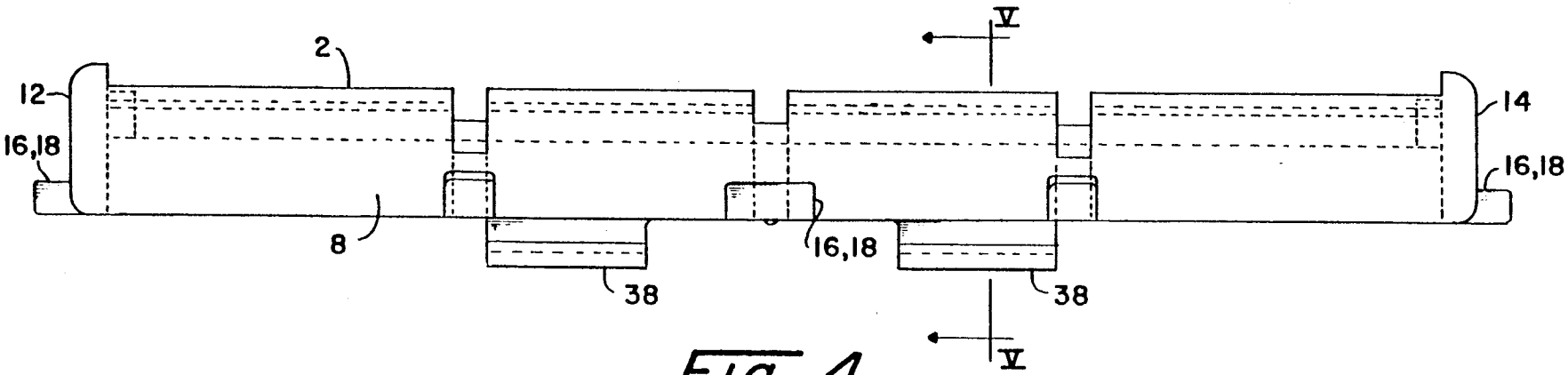
FIG. 4 is a front elevational view of the blade assembly platform member of FIG. 3.
Figure 5:
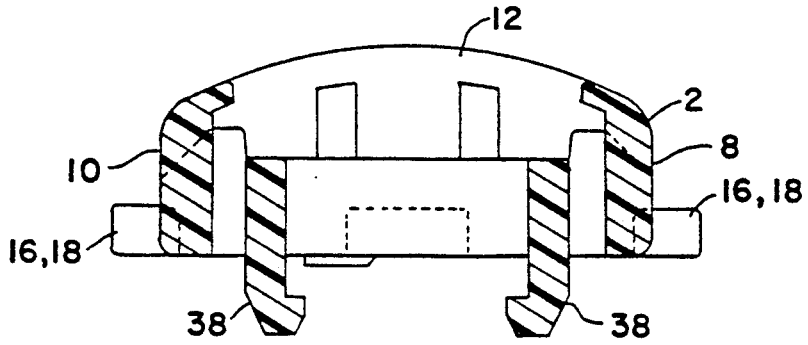
FIG. 5 is a sectional view of the blade assembly platform member of FIG. 4, taken along line V—V of FIG. 4.

As may be seen in FIGS. 3-5, the platform member 2 is provided with a first side wall 8, a second side wall 10, and end walls 12, 14 interconnecting the first and second side walls. The platform member 2 is further provided with first connection means 16 disposed thereon, preferably comprising detents 18 extending outwardly from each of the first and second side walls 8, 10 and end walls 12, 14.

The blade means 4 includes cutting edge means 20 (FIGS. 1 and 2), generally facing in the direction of the first side wall 8 and/or cutting edge means 22, generally facing in the direction of the second side wall 10. Accordingly, movement of the blade assembly in either of two directions may constitute a shaving stroke, as in the case of the well known double edge razors. Though not shown, it will be appreciated that the cutting means of the razor may face in one direction only, as in the case of single-edge razors and other razors having blade edge means facing in one direction only.

Figure 6:
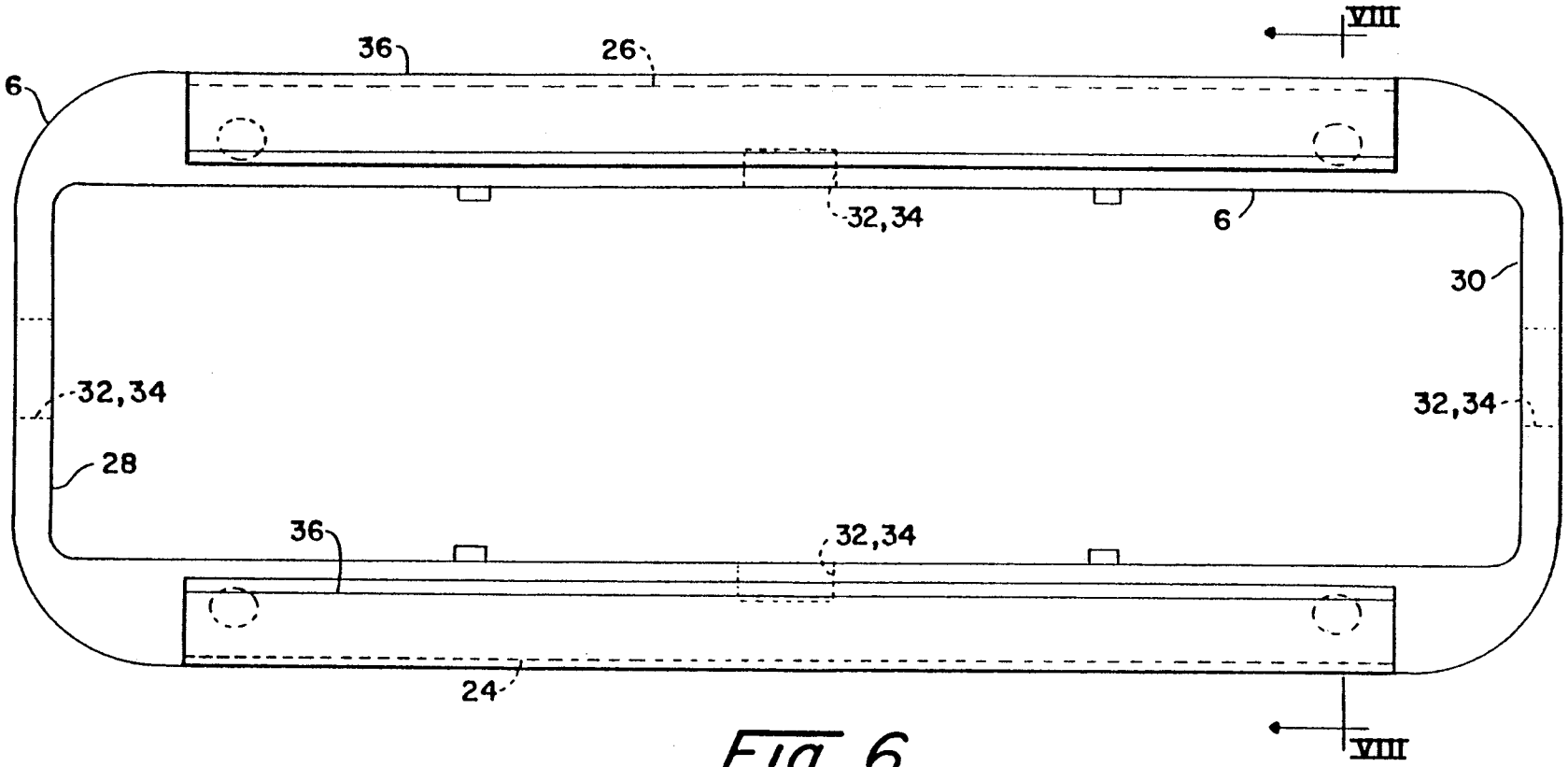
FIG. 6 is a top plan view of a frame member of the blade assembly shown in FIG. 2.
Figure 7:
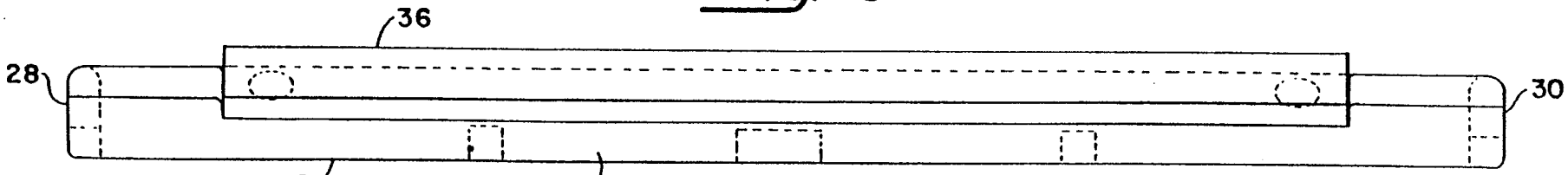
FIG. 7 is a front elevational view of the frame member of FIG. 6.
Figure 8:
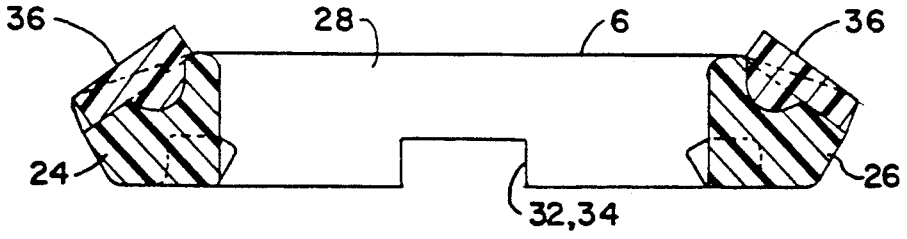
FIG. 8 is a sectional view of the frame member taken along line VIII—VIII of FIG. 7.

Referring to FIGS. 6–8, it will be seen that the frame member 6 is provided with first and second side walls 24, 26 interconnected by end walls 28, 30. The frame member 6 is adapted to receive the platform member 2 interiorly of the frame member 6. The frame member 6 is provided with second connection means 32 disposed thereon and adapted to engage the platform member first connection means 16. The second connection means preferably comprise recesses 34 in the side walls 24, 26 and end walls 28, 30 adapted to receive the platform member detents 18 to releasably connect the frame member 6 to the platform member 2. In connecting the frame member 6 to the platform member 2, the detents 18 snap into the recesses 34 with a pronounced feel and sound, so as to communicate to the user that the frame member is safely and securely connected.

In the embodiment illustrated, the side walls 24, 26 of the frame member 6 have fixed thereto shaving aid bodies 36 which are adapted to be skin engaging portions of the blade assembly. Alternatively, the side walls 24, 26 may in their substantial entireties comprise shaving aid bodies.

In operation, the blade assembly, comprising the platform member 2, blade means 4 and frame member 6, is used in wet shaving in a manner well known. When the operator would like to change types of shaving aids, the frame member 6 is manually removed from the platform member 2, overcoming the holding force of the detents 18. A new frame member 6 is snapped onto the platform member and shaving operations resumed. When the frame member 6 is used in conjunction with a razor having blade means facing in one direction only, such that the trailing shaving aid body fails to engage the surface being shaved during shaving strokes, the operator may elect to simply reverse the frame member 6, such that the previous trailing shaving aid body becomes the leading shaving aid body. After exhaustion of both shaving aid bodies, or after use of a specialized shaving aid is completed, the frame member 6 is replaced with a new frame member, as described above.

The blade assembly may be provided with attachment means 38 (FIG. 5) for releasable attachment to a razor handle, or may be permanently attached to a handle, as is common in "disposable" razors.

It is to be understood that the present invention is by no means limited to the particular construction herein disclosed and/or shown in the drawings, but also comprises any modifications or equivalents within the scope of the claims. For example, while the above description has been directed primarily to shaving aids of the chemical type, that is, shaving aid bodies having a chemical component which is water activatable and leachable out to deposit on the skin, it is also contemplated that shaving aid bodies of the mechanical type might be used in the present invention. In PCT patent application Ser. No. US89/04588, filed Oct. 13, 1989, there are disclosed a number of skin engaging surface configurations and textures for providing frictional sensations to the surface being shaved. Using the present invention, an operator is able to switch from a given guard surface, for example, a very rough surface, to another guard surface, for example, a very smooth surface. Another example of an alternative construction contemplated as within the scope of the present invention is in the use, as a component of the invention, of a blade means other than that illustrated. The blade means illustrated includes two opposed cutting edges, but just as useful in the invention are blade means having cutting edges directed away from each other, as shown in U.S. Pat. No. 4,184,247, issued Jan. 22, 1980 in the name of Norman D. Poisson. Other examples of blade means suitable for use in the invention are tubular type blade arrangements, such as those shown in U.S. Pat. No. 4,807,360, issued Feb. 28, 1989 in the name of Jeffrey C. Cerrier et al, foil type blade means as shown in U.S. Pat. No. 2,439,909, issued Apr. 20, 1948 and single edge, or single-directional, blade means. In the case in which the frame member 6 is adapted for use with a single edge or single directional blade means, the frame member may be provided with a single shaving aid body, rather than the two illustrated.

Having thus described my invention, what I claim as new and desire to secure by Letters Patent of the United States is:

1. A razor blade assembly comprising a platform member including a first side wall, a second side wall, end walls interconnecting said first and second side walls, blade means mounted on said platform member, first connection means disposed on said platform member first and second side walls, and a frame member having first and second side walls interconnected by end walls, said frame member being adapted to receive said platform member interiorly of the frame member, and second connection means disposed on said frame member first and second side walls and adapted to engage said platform member first connection means on said platform member first and second side walls, respectively, to releasably connect said frame member first and second side walls to said platform member first and second side walls, respectively.

2. The razor blade assembly in accordance with claim 1 in which said first and second connection means comprise detent and recess snap engagement means.

3. The razor blade assembly in accordance with claim 2 in which said first connection means comprise detents extending from said platform member first and second side walls and said second connection means comprise recesses disposed in said frame member first and second side walls, said recesses being adapted to receive said detents in snap-in fashion.

4. The razor blade assembly in accordance with claim 1 and further comprising a first shaving aid body disposed on said frame first side wall.

5. The razor blade assembly in accordance with claim 4 and further comprising a second shaving aid body disposed on said frame second side wall.

6. The razor blade assembly in accordance with claim 5 in which said first and second connection means comprise detent and recess snap engagement means.

7. The razor blade assembly in accordance with claim 6 in which said first connection means comprise detents extending from said platform member first and second side walls and said second connection means comprise recesses disposed in said frame member first and second side walls, said recesses being adapted to receive said detents in snap-in fashion.

8. The razor blade assembly in accordance with claim 7 in which further of said detents extend outwardly from said platform member end walls, and further of said recesses are disposed in said frame member end walls, further facilitating said frame member being snapped onto said platform member and releasably held thereon.

9. The razor blade assembly in accordance with claim 1 in which said frame first side wall comprises a shaving aid body.

10. The razor blade assembly in accordance with claim 9 in which said frame second side wall comprises a shaving aid body.

11. The razor blade assembly in accordance with claim 10 in which said first and second connection means comprise detent and recess snap engagement means.

12. The razor blade assembly in accordance with claim 11 in which said first connection means comprise detents extending from said platform member first and second side walls and said second connection means comprise recesses disposed in said frame member first and second side walls, said recesses being adapted to receive said detents in snap-in fashion.

13. The razor blade assembly in accordance with claim 1 in which said first connection means is further disposed on said platform member end walls, and said second connection means is further disposed on said frame member end walls, said second connection means on said frame member end walls being adapted to engage said first connection means on said platform member end walls to releasably connect said frame member end walls to said platform member end walls.

14. A razor blade assembly comprising a platform member having two side walls interconnected by two end walls, blade means mounted on said platform member, and a frame member having two side walls interconnected by two end walls and adapted to receive said platform member interiorly of the frame member, connection means on each of said side walls and end walls for releasably connecting said frame member to said platform member, said frame member being adapted to present a skin-engaging surface of said blade assembly when said frame member is connected to said platform member, said skin-engaging surface comprising a shaving aid body.

15. The razor blade assembly in accordance with claim 14 in which said connection means comprise detent and recess engagement means.

16. The razor blade assembly in accordance with claim 14 in which said skin-engaging surface comprises said shaving aid body fixed to said frame member.

17. The razor blade assembly in accordance with claim 14 in which said skin-engaging surface comprises a portion of said frame member comprising said shaving aid body.

* * * * *